US010228105B2

(12) United States Patent
Chiron et al.

(10) Patent No.: US 10,228,105 B2
(45) Date of Patent: Mar. 12, 2019

(54) LIGHTING AND/OR SIGNALING DEVICE FOR A MOTOR VEHICLE, PROVIDED WITH A LIGHT MODULE COOLED BY MEANS OF AN AIR FLOW GENERATOR

(71) Applicant: VALEO VISION, Bobigny (FR)

(72) Inventors: Jerome Chiron, Angers (FR); Mehdi Madelaine, Angers (FR); Thomas Daniel, Angers (FR); Joaquim Oliveira, Angers (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 15/609,511

(22) Filed: May 31, 2017

(65) Prior Publication Data

US 2017/0343182 A1 Nov. 30, 2017

(30) Foreign Application Priority Data

May 31, 2016 (FR) ..... 16 54904

(51) Int. Cl.
*F21S 41/00* (2018.01)
*F21S 41/143* (2018.01)
(Continued)

(52) U.S. Cl.
CPC ..... *F21S 41/00* (2018.01); *F21S 41/143* (2018.01); *F21S 41/28* (2018.01); *F21S 43/14* (2018.01);
(Continued)

(58) Field of Classification Search
CPC ..... F21S 41/00; F21S 41/143; F21S 41/28; F21S 43/26; F21S 43/14; F21S 45/60; F21S 45/47; F21S 45/43; F21S 45/42
See application file for complete search history.

(56) References Cited

U.S. PATENT DOCUMENTS

2009/0303742 A1* 12/2009 Yasuda ..... F21V 29/71 362/547
2014/0321148 A1 10/2014 Bauer et al.

FOREIGN PATENT DOCUMENTS

EP 2 020 569 A2 2/2009
JP 2005-190825 7/2005
WO WO 2013/134804 A1 9/2013

OTHER PUBLICATIONS

French Preliminary Search Report dated Nov. 24, 2016 in French Application 16 54904 filed on May 31, 2016 (with English Translation of Categories of Cited Documents).

* cited by examiner

*Primary Examiner* — David V Bruce
(74) *Attorney, Agent, or Firm* — Oblon, McClelland, Maier & Neustadt, L.L.P.

(57) ABSTRACT

The present invention concerns a lighting and/or signaling device (10) for a motor vehicle, said lighting and/or signaling device (10) comprising:
- a housing (1);
- an outer lens (3) designed to close the housing (1);
- at least one light module (5) housed inside said housing (1) comprising:
  - at least one optical surface (9, 9', 9'');
  - at least one light source (7, 7') interacting with said optical surface (9, 9') to form a light beam;
  - a heat sink (11) comprising a plurality of fins (13);
- an air flow generator (15) designed to generate an air flow (17) towards the heat sink (11), said air flow (17) passing through the fins (13) of the heat sink (11); and
- a light module holder (19) comprising a front part (20*a*) oriented toward the outer lens (3) with a plurality of gaps (21) designed to direct the air flow (17) coming from the heat sink (11) towards the outer lens (3).

22 Claims, 3 Drawing Sheets

(51) Int. Cl.

| | |
|---|---|
| ***F21S 41/20*** | (2018.01) |
| ***F21S 43/14*** | (2018.01) |
| ***F21S 43/20*** | (2018.01) |
| ***F21S 45/42*** | (2018.01) |
| ***F21S 45/43*** | (2018.01) |
| ***F21S 45/47*** | (2018.01) |
| ***F21S 45/60*** | (2018.01) |
| *F21S 41/147* | (2018.01) |

(52) U.S. Cl.

CPC ..... *F21S 43/26* (2018.01); *F21S 45/42* (2018.01); *F21S 45/43* (2018.01); *F21S 45/47* (2018.01); *F21S 45/60* (2018.01); *F21S 41/147* (2018.01)

LIGHTING AND/OR SIGNALING DEVICE FOR A MOTOR VEHICLE, PROVIDED WITH A LIGHT MODULE COOLED BY MEANS OF AN AIR FLOW GENERATOR

FIELD OF THE INVENTION

The present invention relates to a lighting and/or signaling device for a motor vehicle.

The invention is particularly, but not exclusively, applicable to lighting devices, such as motor vehicle front headlamps.

PRIOR ART

A lighting and/or signaling device for a motor vehicle, such as a headlamp, comprises, as is known to the person skilled in the art:

- a housing;
- an outer lens designed to close the housing;
- at least one light module housed inside said housing comprising:
  - at least one optical surface;
  - at least one light source interacting with said optical surface to form a light beam;
  - a heat sink comprising a plurality of fins;
- an air flow generator designed to generate an air flow towards the heat sink, said air flow passing through the fins of the heat sink; and
- a light module holder.

As is also known, a rigid air circulation duct is placed between the air flow generator and the outer lens of the housing. This duct brings the hot air that has passed through the fins of the heat sink to an area of the outer lens, referred to as a cold spot, which is liable to have condensation visible when a light source is lit up.

One drawback of this prior art is that it is necessary to provide an air circulation duct specifically to circulate air between the air flow generator and the outer lens of the housing. This involves the use of one or more additional parts in the housing, leading to higher manufacturing costs and making the unit bulkier.

In this context, the present invention aims to overcome the abovementioned drawbacks.

GENERAL DESCRIPTION OF THE INVENTION

To this end, the invention proposes a lighting and/or signaling device for a motor vehicle, said lighting and/or signaling device comprising:

- a housing;
- an outer lens designed to close the housing;
- at least one light module housed inside said housing comprising:
  - at least one optical surface;
  - at least one light source interacting with said optical surface to form a light beam;
  - a heat sink comprising a plurality of fins;
- an air flow generator designed to generate an air flow towards the heat sink, said air flow passing through the fins of the heat sink; and
- a light module holder comprising a front part oriented toward the outer lens with a plurality of gaps designed to direct the air flow coming from the heat sink towards the outer lens.

The light module holder is a part that already exists in the housing, it is thus not necessary to use an additional element as in the prior art to ensure air circulation. Moreover, the circulation of air between the air flow generator and the heat sink is direct, without the need for any duct. The number of parts in the lighting and/or signaling device is thereby reduced, as are, therefore, the manufacturing costs.

According to non-limiting embodiments, the lighting and/or signaling device may further comprise one or more additional features, as follows:

According to one non-limiting embodiment, the lighting and/or signaling device comprises an internal wall designed to direct the air flow coming from the heat sink towards the gaps in the light module holder.

According to one non-limiting embodiment, the internal wall belongs to the housing.

According to one non-limiting embodiment, the internal wall belongs to an additional structural member. This additional structural member is a shell.

According to one non-limiting embodiment, the internal wall and the light module holder form between them a space which is sufficient to guide the air flow towards the outer lens.

According to one non-limiting embodiment, the fins of the heat sink are arranged in a first plane and the gaps in the light module holder are arranged in a second plane, said first and second planes being parallel.

According to one non-limiting embodiment, the fins of the heat sink are spaced apart by a first distance and the gaps in the light module holder are spaced apart by a second distance, the first distance and the second distance being identical.

According to one non-limiting embodiment, the number of gaps in the light module holder is higher than the number of fins of the heat sink.

According to one non-limiting embodiment, each gap in the light module holder is made up of an inlet, an outlet and two walls connecting said inlet to said outlet, the outlet having a section S3 which is greater than a section S2 of the inlet.

According to one non-limiting embodiment, said walls of the gap are fixed.

According to one non-limiting embodiment, said walls of the gap are movable.

According to one non-limiting embodiment, the light module holder is fixed with respect to the housing.

According to one non-limiting embodiment, the light module holder is movable with respect to the housing in such a way that it pivots in accordance with a turn or becomes inclined in accordance with the seat of the motor vehicle.

According to one non-limiting embodiment, the lighting and/or signaling device comprises an additional source of heat.

According to one non-limiting embodiment, the additional source of heat is a heating resistor.

According to one non-limiting embodiment, the material constituting the light module holder is:

- polybutylene terephthalate;
- glass fiber filled polyamide;
- a rigid moldable plastic;
- aluminum; or
- steel.

According to one non-limiting embodiment, the light source is one or several semi-conductor emitter chip.

According to one non-limiting embodiment, the semi-conductor emitter chip forms part of a light-emitting diode.

According to one non-limiting embodiment, the lighting and/or signaling device further comprises a mask arranged with respect to the outer lens in such a way as to block the passage of the air flow between said mask and said outer lens.

According to one non-limiting embodiment, said mask is moreover arranged with respect to the optical surface in such way as to have sufficient space to guide the air flow towards the outer lens.

According to one non-limiting embodiment, the lighting and/or signaling device further comprises a light guide and a light guide support means, said light guide support means being arranged with respect to an upper part of the outer lens in such a way as to have sufficient space to allow the air flow to pass along the upper part of the outer lens.

According to one non-limiting embodiment, the lighting and/or signaling device is a front headlamp of a motor vehicle.

BRIEF DESCRIPTION OF THE FIGURES

The invention and the various uses thereof shall become clearer on reading the following description and referring to the accompanying drawings.

DESCRIPTION OF EMBODIMENTS OF THE INVENTION

Elements which are identical, in terms of structure or of function, shown in the various figures have the same reference signs, unless otherwise specified.

The lighting and/or signaling device 10 for a motor vehicle according to the invention is described with reference to FIGS. 1 to 6.

"Motor vehicle" means any kind of motorized vehicle.

According to one non-limiting embodiment discussed in the rest of the description, the lighting and/or signaling device 10 is a front headlamp of a motor vehicle.

Figure 1:
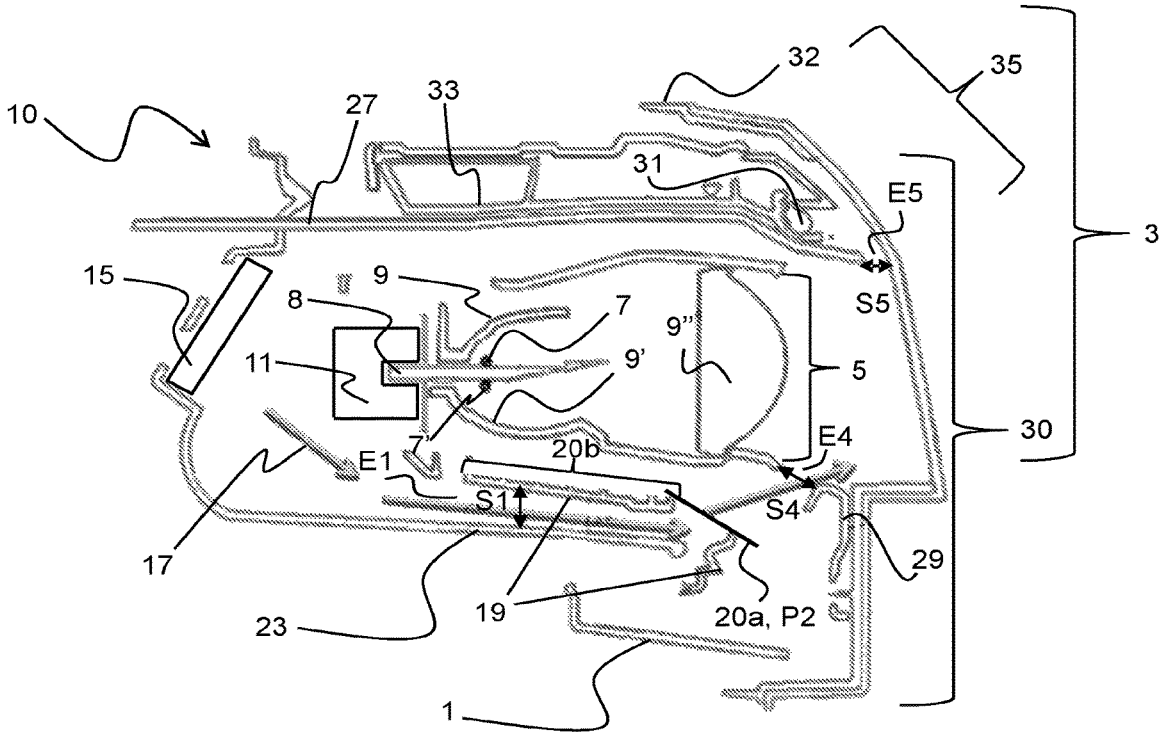
FIG. 1 shows a sectional view of a lighting and/or signaling device for a motor vehicle according to a first non-limiting embodiment of the invention.
Figure 4:
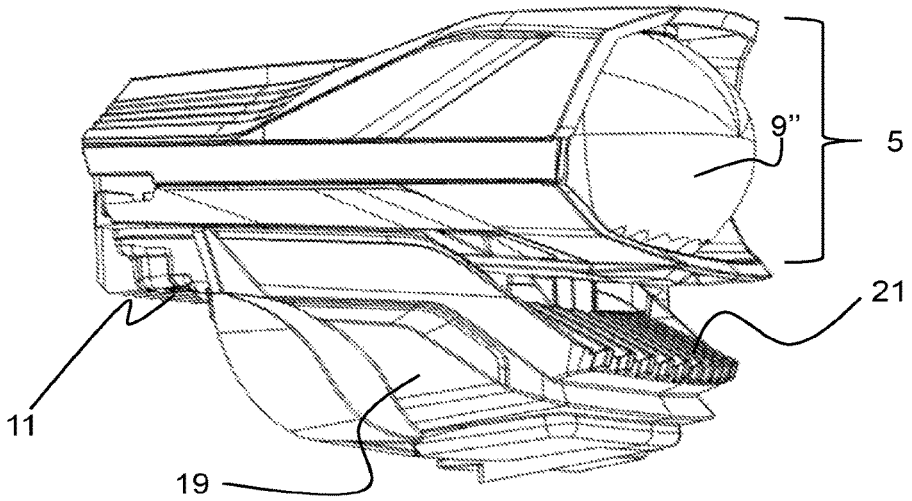
FIG. 4 shows a perspective view of a part of the lighting and/or signaling device of FIG. 1.

As shown in section in FIG. 1 and in the perspective view of FIG. 4, the lighting and/or signaling device 10 comprises:

- a housing 1;
- an outer lens 3 designed to close the housing 1;
- at least one light module 5 housed inside said housing 1 and bound to a heat sink 11 comprising a plurality of fins 13;
- an air flow generator 15 designed to generate an air flow 17 towards the heat sink 11, all or part of the air flow 17 passing through the fins 13 of the heat sink 11;
- a light module holder 19 comprising a front part 20 oriented toward the outer lens 3 with a plurality of gaps 21 designed to direct the air flow 17 coming from the heat sink 11 towards the outer lens 3.

According to one non-limiting embodiment, the lighting and/or signaling device 10 further comprises an additional structural member 23, called a shell. Said shell is fitted and secured to the housing 1.

The various elements of the lighting and/or signaling device are described in detail below.

The housing 1 is designed to receive the light module or modules 5, each one with their heat sink 11, the air flow generator 15 and the light module holder 19 of each of the light module 5. It thus defines an internal space for receiving all these elements.

The outer lens 3 is designed to close the housing 1. According to one non-limiting embodiment, it comprises a transparent zone 30 and a black zone 32. The transparent zone 30 is what is referred to as a cold spot, where there is a likelihood of condensation or ice forming on the inside surface thereof. The black zone 32 is an aesthetic part for concealing the interior of the lighting and/or signaling device 10. Naturally, in another non-limiting embodiment, the outer lens 3 may be completely transparent, with no black zone.

According to one non-limiting embodiment, a light module 5 comprises at least one optical surface and at least one light source interacting with said optical surface to create a light beam.

As shown in FIG. 1, in one non-limiting embodiment, the light module 5 comprises:

- a first light source 7 and a second light source 7'. The first light source 7 is, for example, a light source dedicated to perform a "high beam" lighting function. The second light source 7' is dedicated to perform a "low beam" lighting function, for example.
- a first optical surface 9 and a second optical surface 9' interacting with the first light source 7 and the second light source 7', respectively. The first optical surface 9 is in this case a reflector designed to reflect a light ray coming from the first light source 7. The second optical surface 9' is in this case a reflector designed to reflect a light ray coming from the second light source 7'. All the reflected light rays form a global light beam.
- a third optical surface 9", which is in this case a lens designed to channel and orient the global light beam.

According to one non-limiting embodiment, the light sources 7, 7' are one or several semi-conductor emitter chips.

According to one non-limiting variant of an embodiment, each semi-conductor emitter chip forms part of a light-emitting diode. "Light-emitting diode" means any type of light-emitting diode, such as an LED proper, OLED (organic LED), AMOLED (Active-Matrix-Organic LED), or FOLED (Flexible OLED), to give some non-limiting examples.

The first light source 7 and the second light source 7' are mounted on a heat conductive plate 8 which transmits the heat generated by the light sources 7, 7' to the heat sink 11.

FIG. 1 shows a sectional view of the lighting and/or signaling device 10. As described above, the lighting and/or signaling device 10 comprises the air flow generator 15 designed to generate the air flow 17. The term "air flow generator" means a fan designed to blow a certain volume of air in the direction of the heat sink 11. The fan 15 is here secured to the shell 23. It can be secured to other zones or element of the housing 1.

The heat sink 11 is designed to dissipate the heat given off by the light module 5 during operation. It is therefore physically connected to the light module 5.

Figure 2:
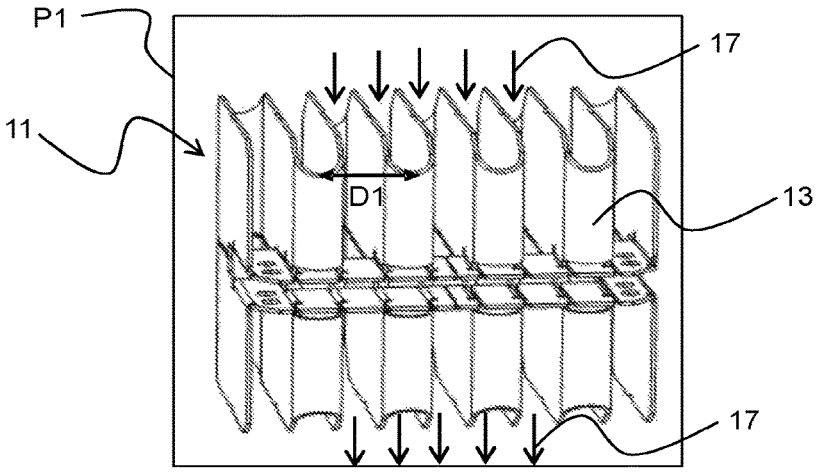
FIG. 2 shows a perspective view of a heat sink of the lighting and/or signaling device of FIG. 1.
Figure 3:
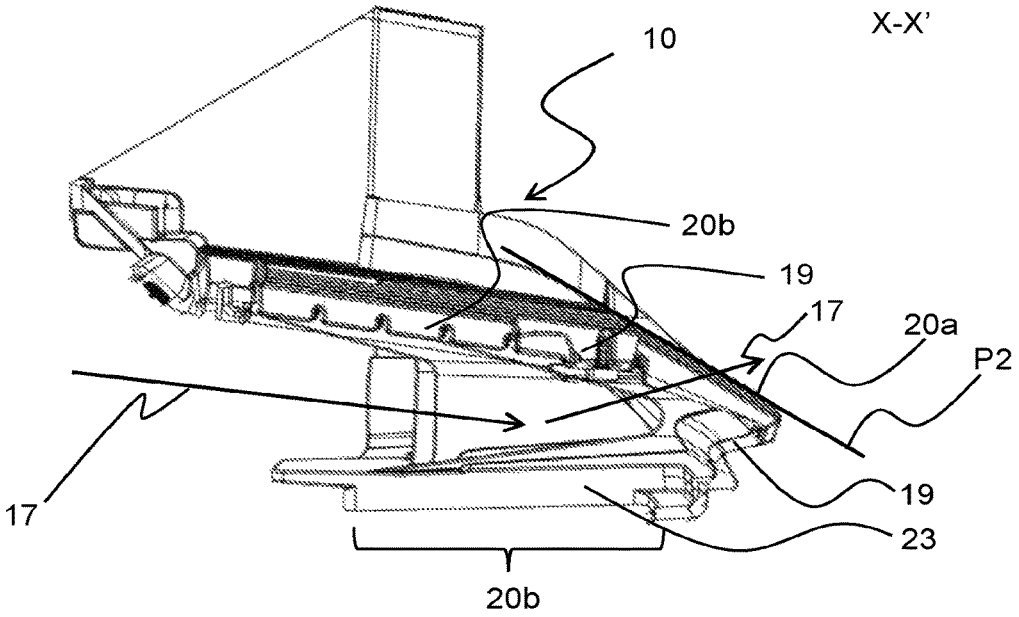
FIG. 3 shows an enlarged view of FIG. 1 in the area of a light module holder belonging to the lighting and/or signaling device.

As shown in FIG. 2, the heat sink 11 comprises a plurality of fins 13 through which the air flow 17 coming from the air flow generator 15 passes.

According to one non-limiting embodiment, the fins 13 of the heat sink 11 are parallel to one another and spaced apart by a first distance D1. Thus, the air flow 17 is split into a plurality of secondary flows by the fins 13 of the heat sink 11. Each secondary flow is heated by the fins 13.

According to one non-limiting embodiment, the fins 13 are arranged in a first plane P1.

The heat sink 11 then directs the air flow 17 towards the light module holder 19.

The light module holder 19 is designed to direct the air flow 17 towards the outer lens 3. The light module holder 19 bears the light module 5 and the associated heat sink 11. It also has an aesthetic purpose.

According to a first embodiment, the light module holder 19 is fixed (non movable) with respect to the housing 1.

According to a second non-limiting embodiment, the light module holder 19 is movable with respect to the housing 1 in such a way that it pivots in accordance with a turn or becomes inclined in accordance with the seat of the motor vehicle comprising the lighting and/or signaling device. To this end, the lighting and/or signaling device 10 comprises one or more motors and a connecting rod system (not shown). The motor or motors are linked to the angle of rotation of the steering wheel of the vehicle so as to pivot the lighting and/or signaling device in accordance with a turn. Likewise, the motor or motors may be linked to the vehicle seat.

According to non-limiting embodiments, the material constituting the light module holder 19 is:

pbt (polybutylene terephthalate); or glass fiber filled polyamide (known under the name gf30); or a rigid moldable plastic; or aluminum; or steel.

As shown in FIG. 1, the light module holder 19 comprises a front part 20*a* and a rear part 20*b*. The front part 20*a* is oriented toward the outer lens and comprises a plurality of gaps 21 designed to direct the air flow 17 towards an outer lens 3. The rear part 20*b* forms with an internal wall of the lighting and/or signaling device 10 a duct for guiding the air flow 17 towards the gaps 21 in the front part 20*a*.

In the embodiment of FIG. 1, the internal wall belongs to the additional structural member 23, in this case the shell.

In another non-limiting embodiment, the internal wall belongs to the housing 1.

The duct formed by the internal wall (1 or 23) and the rear part 20*b* of the light module holder 19 has a space E1 (shown in FIG. 1) which is sufficient to guide the air flow 17 towards the front part 20*a* of the light module holder 19. In one non-limiting embodiment, the space E1 is between 20 mm (millimeters) and 30 mm. This space E1 has a section S1 that decreases in the direction of the front part 20*a* of the light module holder 19, speeding up the air flow 17 in the direction of this front part 19*a*. Furthermore, as may be seen in FIG. 1, the light module holder 19 and the internal wall direct the air flow 17 in the direction of the gaps 21 in the front part 20*a* of the light module holder 19.

The gaps 21 are in this case arranged in a second plane P2.

According to one non-limiting embodiment, the second plane P2 of the gaps 21 is parallel to the first plane P1 of the fins 13. This makes it possible to reduce the turbulence in the air flow 17.

In another non-limiting embodiment (not shown), the second plane P2 of the gaps 21 is coplanar with the first plane P1 of the fins 13. The fins 13 are thus aligned with the gaps 21. This makes it possible to avoid drops in the speed of the air flow 17.

Figure 5:
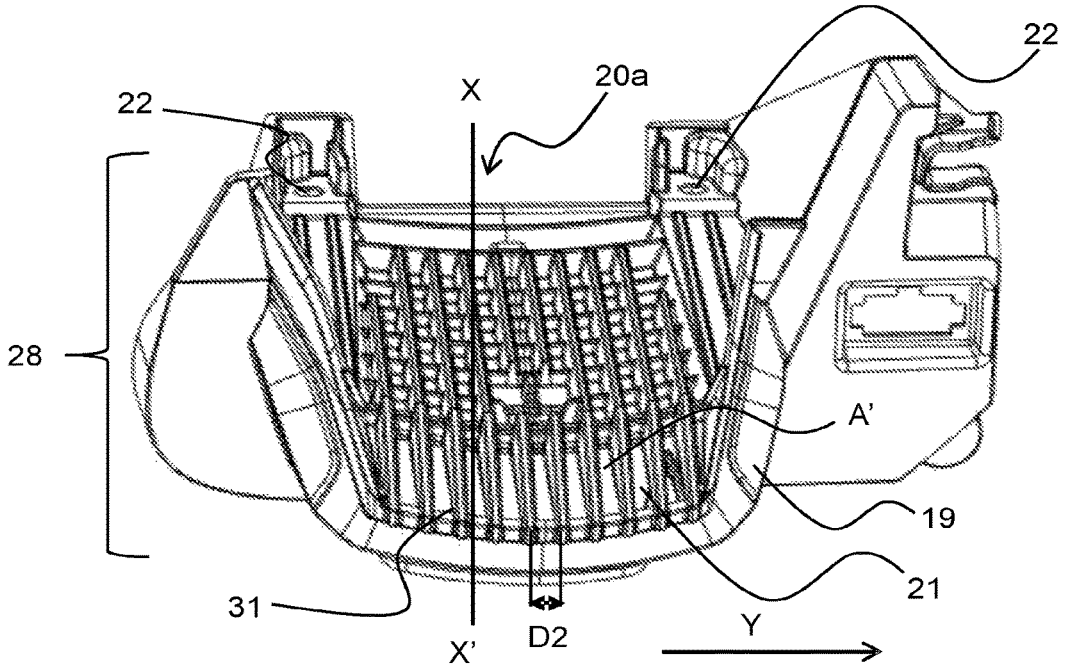
FIG. 5 shows a perspective view of a front part of the light module holder of FIG. 3.

FIG. 5 shows a perspective view of the front part 20*a* of the light module holder 19. This front part 20*a* comprises a grille 28. This grille 28 has, on a lower part, a plurality of gaps 21. The gaps 21 in the light module holder 19 are spaced apart by a second distance D2.

According to one non-limiting embodiment, the first distance D1 between two adjacent fins 13 of the heat sink 11 is identical to the second distance D2 between two gaps in the grille 28. Thus, each secondary flow formed by the heat sink 11 will be able to pass through a gap 21 in the light module holder. For each secondary flow, there is therefore an associated pair of adjacent fins/gap. The circulation of the secondary flows is thereby boosted and the pressure drop of the flow 17 is consequently limited. This results in less turbulence and a better heat exchange.

According to one non-limiting embodiment, the number of gaps 21 in the light module holder 19 is higher than the number of fins 13 of the heat sink 11. This has an aesthetic effect visible to an observer outside the motor vehicle. According to one non-limiting embodiment, the light module holder 19 comprises holes 22 for the passage of fixing screws for securing the light module holder 19 to the rest of the lighting and/or signaling device 1.

Figure 6:
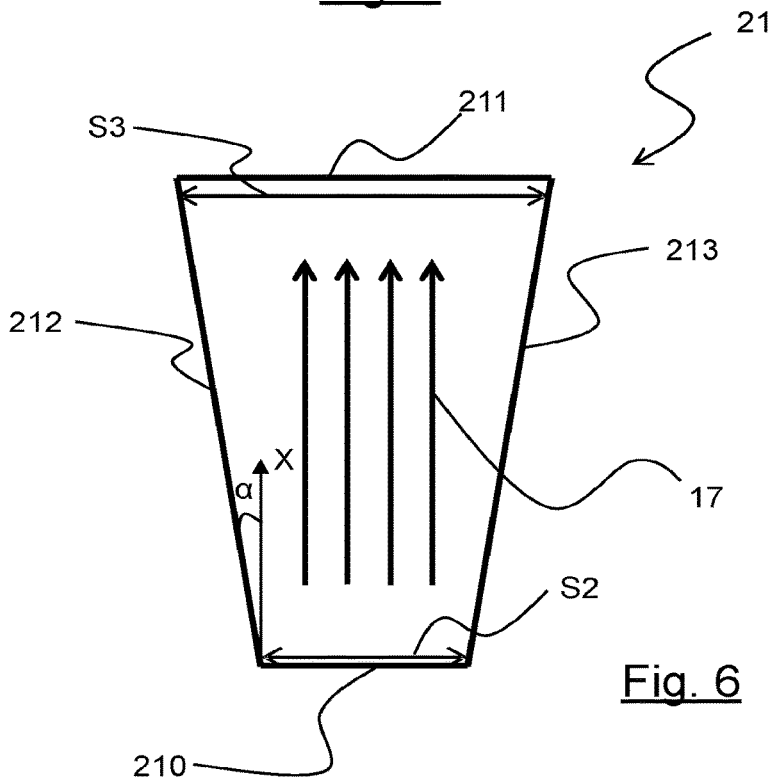
FIG. 6 shows a sectional view of a gap included in the front part of the light module holder of FIGS. 3 and 5.

FIG. 6 shows a sectional view of a gap 21 in the front part 20*a* of the light module holder 19 according to one non-limiting embodiment. This gap 21 is made up of an inlet 210 (through which the air flow 17 enters), an outlet 211 (through which the air flow 17 exits) and two walls 212, 213 connecting the inlet 210 and the outlet 211. The inlet 210 has a section S2 and the outlet 211 has a section S3.

According to one non-limiting embodiment, the section S3 of the outlet 211 is greater than the section S2 of the inlet 210. This creates a Venturi effect at the gap 21. This Venturi effect increases the speed of the air flow 17 in the direction of the outer lens 3. This increase in speed improves the de-icing of and/or removal of condensation from said outer lens 3. The time needed for removing condensation and/or de-icing is therefore reduced.

According to one non-limiting embodiment, the walls 212, 213 are flat in such a way as to promote the movement of the air flow and limit the pressure drop. As can be seen in FIG. 6, the walls 212, 213 of the gap 21 make an angle $\alpha$ with a direction X, corresponding to the direction of travel of the vehicle.

In a first non-limiting embodiment, the angle $\alpha$ is constant and the walls 212, 213 of the gap are fixed.

In a second non-limiting embodiment, the angle $\alpha$ varies and the walls 212, 213 of the gap 21 are movable. To make these walls 212, 213 movable, the lighting and/or signaling device 10 comprises a motor (not shown) and a connecting rod system (not shown) connected to the walls of the gap 21. It is thus possible to direct the flow 17 over particular areas of the outer lens. De-icing and/or the time taken to remove condensation in these particular areas of the outer lens 3 is/are thereby improved.

To improve de-icing of and/or the time taken to remove condensation from the outer lens 3, according to one non-limiting embodiment, the lighting and/or signaling device 10 further comprises an additional source of heat (not shown). It is thus possible to de-ice and/or remove condensation present on the outer lens 3 from cold, in other words:

without switching on the light sources 7, 7' of the light module 5, for example when starting up the vehicle;

when the light sources 7, 7' of the light module 5 have just been lit up, during the time it takes for the heat sink 11 to dissipate the heat coming from the light module 5 in operation.

According to one non-limiting embodiment, the additional source of heat is a heating resistor.

According to one non-limiting embodiment, the additional source of heat is arranged in the air flow 17 on the internal wall over which the air flow 17 passes, upstream or downstream of the gaps 21. In non-limiting examples, the additional source of heat is secured to the shell 23 or to the housing 1.

According to one non-limiting embodiment, the lighting and/or signaling device 10 further comprises at least one mask which has an aesthetic purpose.

As shown in FIG. 1, the lighting and/or signaling device 10 comprises a mask 27 arranged along a light guide support means 33 (described below) and a mask 29 arranged between the light module holder 19 and the outer lens 3.

The mask 29 defines with the optical surface 9', a space E4 with a section S4 sufficient for the passage of the air flow.

It is thus possible to guide the air flow 17 coming from the light module holder 19 towards the upper part of the outer lens 3. According to one non-limiting example, the space E4 is between 10 mm and 15 mm.

According to one non-limiting embodiment, the mask 29 is arranged with respect to the outer lens 3 in such a way as to block the passage of part of the air flow 17 between this mask 29 and the outer lens 3. This ensures that all of the air flow 17 coming from the light module holder 19 is guided towards the zones 30, 32 of the outer lens 3 that require de-icing and/or removal of condensation.

According to one non-limiting embodiment, as shown in FIG. 1, the lighting and/or signaling device 10 further comprises a light guide 31 and a light guide support means 33. The light guide support means 33 is arranged with respect to an upper part 35 of the outer lens 3 in such a way as to have a space E5 with a section S5. This space E5 is sufficient to allow the air flow 17 to pass along the upper part 35 of the outer lens 3. This expels the air flow 17 out of the lighting and/or signaling device 10, once the operation of de-icing and/or removal of condensation has been completed. In one non-limiting embodiment, the space E5 is at least equal to 5 mm.

The description of the invention is of course not limited to the embodiments described above.

Thus, according to one non-limiting embodiment, the lighting and/or signaling device 10 may be dual-module, meaning that it may comprise two light modules 5 mounted on their module holders 19, each light modules 5 being associated to a respective fan 15. The two light module holders 19 interact with each of the fans 15 and of the light modules 5 as described above, and thus have gaps 21 as described above to direct the air flow 17 towards the outer lens 3. According to a preferred embodiment, to optimize costs, it is possible to provide only one common fan 15 to the two lighting module 5. In this embodiment, it can be defined that only one of the two light module holders 19 has gaps 21 as described above to direct the air flow 17 towards the outer lens 3. The other light module holder has then a solid front part 20*a*, without gaps 21. In this case, the light module holder 19 with the gaps 21 will interact more specifically with the light module 5 whose light sources 7, 7' give off the most heat when in operation.

In a first non-limiting variant of this embodiment, one light module 5 is designed to perform the "high beam" lighting function and the other light module is designed to perform the "low beam" lighting function.

In a second non-limiting variant of this embodiment, each light module 5 is designed to perform part of the "high beam" lighting function and part of the "low beam" lighting function. Thus, each light module 5 comprises light sources 7 and 7' (described above).

This makes it possible to optimize the power of the light sources 7 and 7' because the power of the light sources associated with a lighting function is shared between two light modules 5.

Note that the light beam produced to perform the "low beam" lighting function has a cutoff. It thus comprises two segments, one of which is horizontal and the other of which is inclined. Thus, in this second variant, one of the light modules 5 comprises the light sources 7' to produce the inclined segment, i.e. to perform a "kink" sub-function, while the other light module 5 comprises the light sources 7' to produce the horizontal segment, i.e. to perform a "flat" sub-function.

Thus, the invention described has the following advantages in particular:

- it is possible to efficiently de-ice and/or remove condensation from the cold spots on the outer lens using heat coming from a light module belonging to the lighting and/or signaling device. The optical performance of the lighting and/or signaling device is thus no longer impaired by condensation or ice, and there is no longer any aesthetic problem as there are no longer drops of condensation on the inside surface of the outer lens 3;
- the air flow is directed by means of a light module holder which is a part that already exists in the housing. It is thus not necessary to use a specific additional duct to circulate the air, optimizing the manufacturing costs of the lighting and/or signaling device;
- to improve de-icing of and/or removal of condensation from the outer lens, the air flow is accelerated simply in the light module holder by gaps having specific shapes and inclinations;
- the spacing between the various elements of the lighting and/or signaling device is optimized so as to limit the pressure drop in the air flow;
- it is not necessary to fit an additional part as in the prior art;
- the light module holder is open by virtue of the gaps, improving the circulation of the air towards the cold spot on the outer lens, unlike a light module holder with a solid front part 20*a*.

The invention claimed is:

1. A lighting and/or signaling device for a motor vehicle, said lighting and/or signaling device comprising:
- a housing;
- an outer lens designed to close the housing;
- at least one light module housed inside said housing comprising:
  - at least one optical surface; and
  - at least one light source interacting with said optical surface to form a light beam;
- a heat sink comprising a plurality of fins;
- an air flow generator designed to generate an air flow towards the heat sink, said air flow passing through the fins of the heat sink; and
- a light module holder comprising a front part oriented toward the outer lens, the front part including a plurality of gaps designed to direct the air flow coming from the heat sink towards the outer lens.

2. The lighting and/or signaling device according to claim 1, wherein said lighting and/or signaling device comprises an internal wall designed to direct the air flow coming from the heat sink towards the gaps in the light module holder.

3. The lighting and/or signaling device according to claim 2, wherein the internal wall belongs to the housing.

4. The lighting and/or signaling device according to claim 2, wherein the internal wall belongs to an additional structural member.

5. The lighting and/or signaling device according to claim 2, wherein the internal wall and the light module holder form between them a space which is sufficient to guide the air flow towards the outer lens.

6. The lighting and/or signaling device according to claim 1, wherein the fins of the heat sink are arranged in a first plane and the gaps in the light module holder are arranged in a second plane, said first and second planes being parallel.

7. The lighting and/or signaling device according to claim 1, wherein the fins of the heat sink are spaced apart by a first distance and the gaps in the light module holder are spaced apart by a second distance, the first distance and the second distance being identical.

8. The lighting and/or signaling device according to claim 1, wherein the number of gaps in the light module holder is higher than the number of fins of the heat sink.

9. The lighting and/or signaling device according to claim 1, wherein each gap in the light module holder is made up of an inlet, an outlet and two walls connecting said inlet to said outlet, the outlet having a section which is greater than a section of the inlet.

10. The lighting and/or signaling device according to claim 9, wherein said walls of the gap are fixed.

11. The lighting and/or signaling device according to claim 9, wherein said walls of the gap are movable.

12. The lighting and/or signaling device according to claim 1, wherein the light module holder is fixed with respect to the housing.

13. The lighting and/or signaling device according to claim 1, wherein the light module holder is movable with respect to the housing in such a way that it pivots in accordance with a turn or becomes inclined in accordance with the seat of the motor vehicle.

14. The lighting and/or signaling device according to claim 1, wherein said lighting and/or signaling device comprises an additional source of heat.

15. The lighting and/or signaling device according to claim 14, wherein the additional source of heat is a heating resistor.

16. The lighting and/or signaling device according to claim 1, wherein the material constituting the light module holder is:

polybutylene terephthalate;
glass fiber filled polyamide;
a rigid moldable plastic;
aluminum; or
steel.

17. The lighting and/or signaling device according to claim 1, wherein the light source is a semi-conductor emitter chip.

18. The lighting and/or signaling device according to claim 17, wherein the semi-conductor emitter chip forms part of a light-emitting diode.

19. The lighting and/or signaling device according to claim 1, further comprising a mask arranged with respect to the outer lens in such a way as to block the passage of the air flow between said mask and said outer lens.

20. The lighting and/or signaling device according to claim 19, wherein said mask is arranged with respect to the optical surface in such way as to have sufficient space to guide the air flow towards the outer lens.

21. The lighting and/or signaling device according to claim 1, further comprising a light guide and a light guide support means, said light guide support means being arranged with respect to an upper part of the outer lens in such a way as to have sufficient space to allow the air flow to pass along the upper part of the outer lens.

22. The lighting device according to claim 1, wherein the lighting device is a front headlamp of a motor vehicle.

* * * * *